US008144060B2

(12) United States Patent
Angell et al.

(10) Patent No.: US 8,144,060 B2
(45) Date of Patent: Mar. 27, 2012

(54) MULTIPLE FEEDPOINT ANTENNA

(75) Inventors: Richard Barry Angell, Nevada City, CA (US); Nelson Young, Browns Valley, CA (US)

(73) Assignee: 2Wire, Inc., San Jose, CA (US)

( * ) Notice: Subject to any disclaimer, the term of this patent is extended or adjusted under 35 U.S.C. 154(b) by 756 days.

(21) Appl. No.: 12/131,724

(22) Filed: Jun. 2, 2008

(65) Prior Publication Data

US 2009/0295643 A1 Dec. 3, 2009

(51) Int. Cl.
*H01Q 1/38* (2006.01)

(52) U.S. Cl. ..... 343/700 MS; 343/702; 343/846

(58) Field of Classification Search ..... 343/700 MS, 343/702, 846
See application file for complete search history.

(56) References Cited

U.S. PATENT DOCUMENTS 5,486,836 A 1/1996 Kuffner et al.
6,266,026 B1 7/2001 Stengel, Jr.
6,381,471 B1 4/2002 Dvorkin
6,448,932 B1 * 9/2002 Stoiljkovic et al. .... 343/700 MS
6,512,489 B2 1/2003 Boyle
7,155,252 B2 12/2006 Martin et al.
7,289,068 B2 * 10/2007 Fujio et al. ..... 343/700 MS
2009/0040109 A1 * 2/2009 Iguchi et al. ..... 343/700 MS

* cited by examiner

*Primary Examiner* — Tan Ho
(74) *Attorney, Agent, or Firm* — Head, Johnson & Kachigian P.C.

(57) ABSTRACT

An antenna unit includes one or more antenna circuits coupled to one or more antenna structures. Each antenna structure includes a first feed point and a second feed point to receive signals from a transceiver unit or transmit signals to the transceiver unit. The first feed point of each antenna structure is configured to maximize coupling into an associated antenna structure at a first frequency band and the second feed point of each antenna structure is configured to maximize coupling into an associated antenna structure at a second frequency band. Each antenna structure has a slot that separates each antenna structure into a first patch associated with the first feed point and the first frequency band and a second patch associated with the second feed point and the second frequency band. Each antenna circuit is operatively coupled to the transceiver unit without an intervening multiplexing functionality or circuitry.

21 Claims, 10 Drawing Sheets

MULTIPLE FEEDPOINT ANTENNA

TECHNICAL FIELD

Embodiments of the disclosure generally relate to telecommunication systems that provide broadband access with antennas. More particularly, an aspect of an embodiment of the disclosure relates to providing broadband access with dual or multi-band multiplexing antennas.

BACKGROUND

Typically, telecommunication systems that provide broadband access to customers contain a transceiver such as a residential gateway. The residential gateway consists of a xDSL (any type of digital subscriber line generally communicated over copper lines) modem or xPON (any type of passive optical network generally communicated over optic fibers) interface combined with various local area networking (LAN) technologies to enable sharing the broadband access with other computers or devices within the residence or building. Wireless local area network standards and home phone line networking (HPNA) are examples of such LAN technologies.

A wireless LAN or WLAN is a wireless local area network, which is the linking of two or more computers without using wires. WLAN utilizes spread-spectrum technology based on radio waves to enable communication between devices in a limited area, also known as the basic service set. This gives users the mobility to move around within a broad coverage area and still be coupled to the network. A wireless access point (WAP) provides a wireless LAN by coupling to an Ethernet hub or switch. Each access point is a base station that transmits radio frequency (RF) signals over a radius of some distance.

For a dual frequency band application, the WAP is typically coupled to a dual band antenna with a single feed point to provide the wireless LAN with two frequency bands such as the Institute of Electrical and Electronics Engineers (IEEE) 802.11 industrial, scientific, and medical (ISM) RF bands. This necessitates the use of one or more diplexers to combine and separate the signals being sent to and received from the dual band antenna. One dual band antenna design is illustrated in FIG. 1A. This design includes two diplexers, one for the transmitting signals to the antenna and another diplexer for receiving signals from the antenna. However, these diplexers add additional cost and attenuate the desired signals. These diplexers also add design complexity because the diplexers can distort the desired signals.

Other types of antenna designs may include multiple single-band antennas as illustrated in FIG. 1B. This design also includes two diplexers, one for the transmitting signals to the transmit antenna and another diplexer for receiving signals from the receive antenna. These diplexers and multiple antennas add additional cost and require additional space. Diplexers also add design complexity because they can distort the desired signals.

BRIEF DESCRIPTION OF THE DRAWINGS

The drawings refer to embodiments of the disclosure in which.

DETAILED DESCRIPTION

In the following description, numerous specific details are set forth, such as examples of specific signals, frequency bands, feed points, named components, connections, example frequencies, etc., in order to provide a thorough understanding of the present disclosure. It will be apparent, however, to one of ordinary skill in the art that the present disclosure may be practiced without these specific details. In other instances, well known components or methods have not been described in detail but rather in a block diagram in order to avoid unnecessarily obscuring the present disclosure. The specific details set forth are merely exemplary. Further specific numeric references such as a first frequency band, may be made. However, the specific numeric reference should not be interpreted as a literal sequential order but rather interpreted that the first frequency band is different than a second frequency band. Thus, the specific details set forth are merely exemplary. The specific details may be varied from and still be within the spirit and scope of the present disclosure.

In general, various apparatuses and methods are described in which an antenna unit includes one or more antenna structures each with a resonate plate having a slot that separates the resonate plate into a first patch and a second patch. The first patch is associated with a first feed point and a corresponding first frequency band. The second patch is associated with a second feed point and a corresponding second frequency band. The antenna unit further includes one or more antenna circuits. Each antenna circuit is coupled to the feed points of an associated antenna structure in order to receive one or more signals transmitted from a transceiver unit or to send one or more signals to the transceiver unit.

The first feed point of each antenna structure is configured to maximize coupling into an associated antenna structure at the first frequency band and the second feed point is configured to maximize coupling into an associated antenna structure at the second frequency band. In one embodiment, the first patch has an area that is approximately two to two and one half times larger than an area of the second patch. The first frequency band can be approximately 2.4 to 2.5 GHz and the second frequency band can be approximately 5.15 to 5.85 GHz. Other RF bands can be implemented as well. Each antenna circuit is directly coupled to the transceiver unit without an intervening multiplexing functionality or circuitry. Each antenna structure is operatively coupled to the transceiver unit without an intervening multiplexing functionality or circuitry.

Figure 1A:
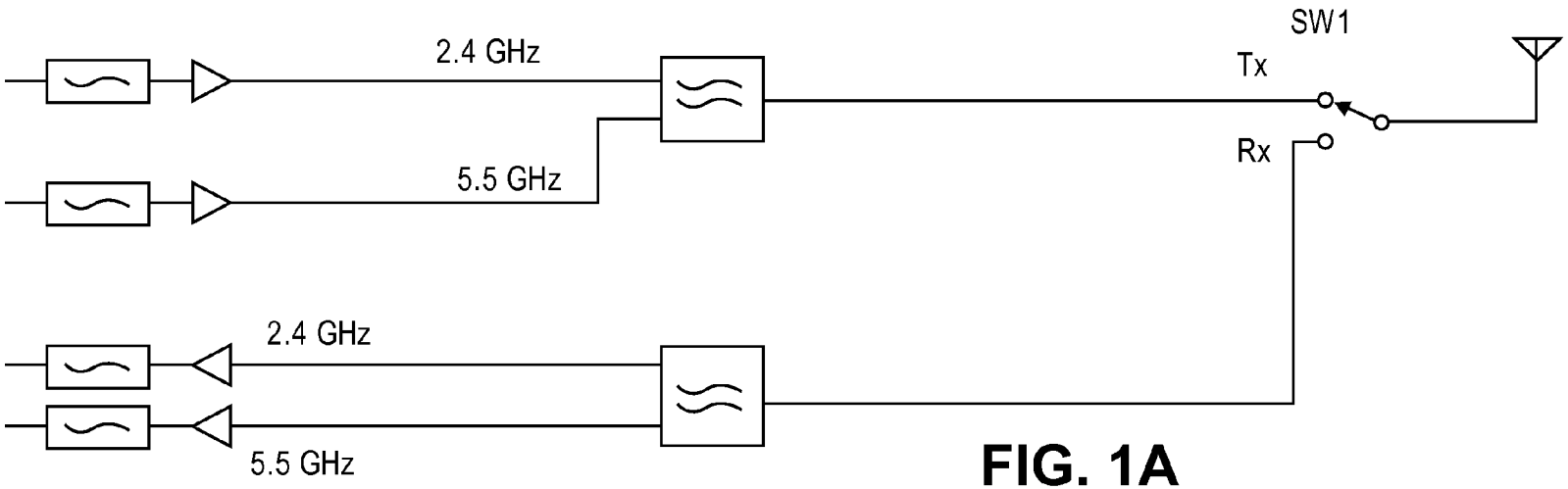
FIG. 1A (PRIOR ART)
FIG. 1A illustrates a dual band antenna design with multiple diplexers in accordance with a prior approach.
Figure 1B:
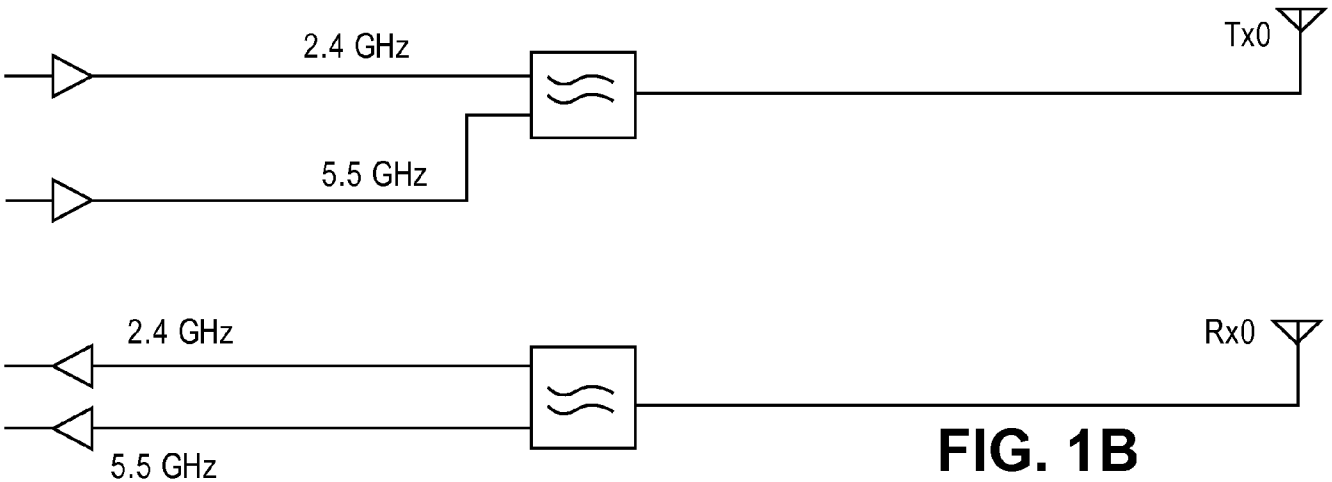
FIG. 1B (PRIOR ART)
FIG. 1B illustrates a single band antenna design with multiple antennas and diplexers in accordance with a prior approach.
Figure 2:
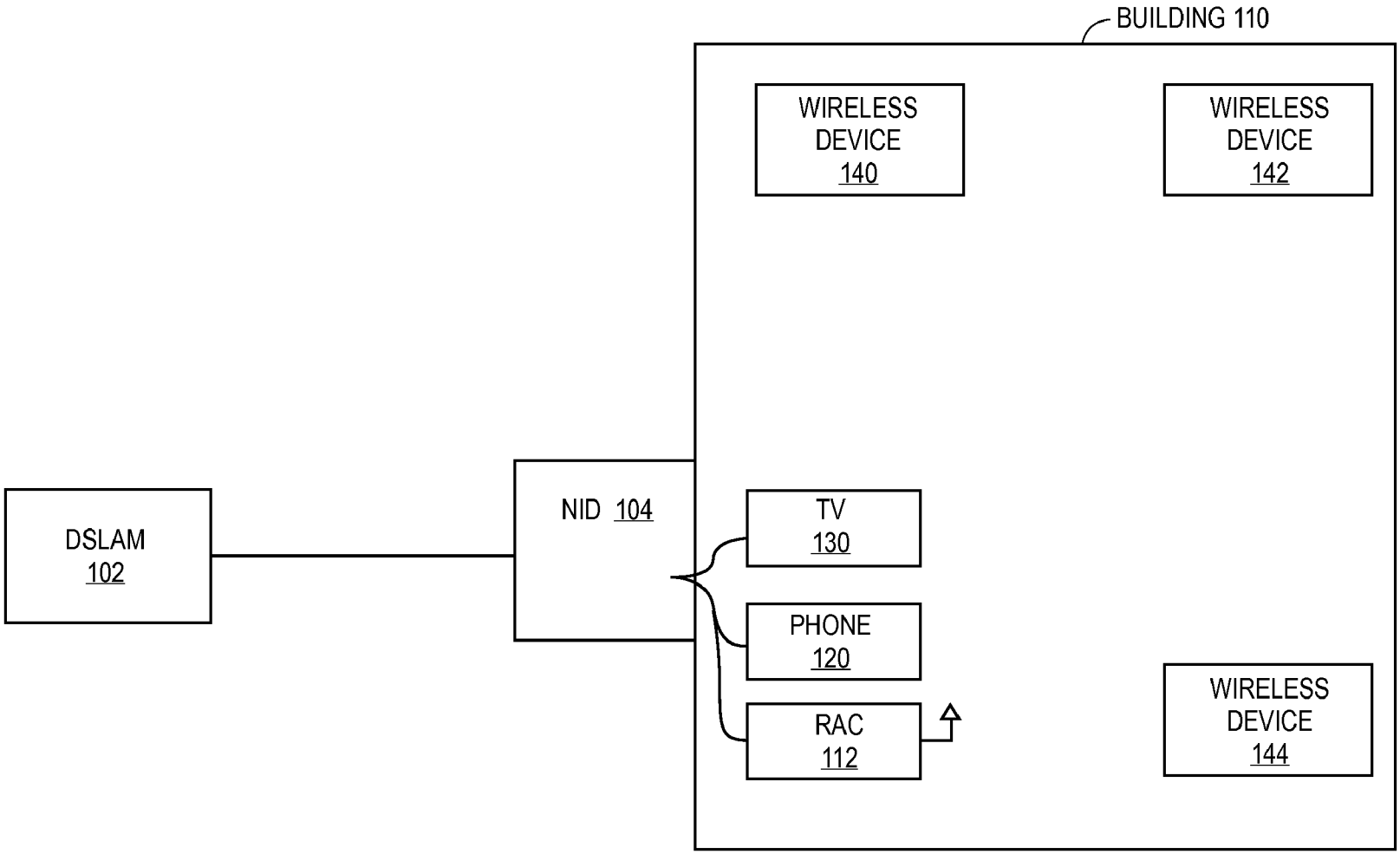
FIG. 2 shows a block diagram of an embodiment of a central office containing a Digital Subscriber Loop Access Multiplexer sending communications across a local loop to a network interface device.

FIG. 2 shows a block diagram of an embodiment of a central office containing a Digital Subscriber Line Access Multiplexer (DSLAM) sending communications across a local loop to a network interface device (NID). A NID is the point of demarcation between the local loop and the end user's inside wire. The DSLAM 102 sends communications to the NID 104 located outside a building 110. The NID 104 includes or is coupled to a WAP having an antenna unit 112 that includes an integrated circuit (e.g., transceiver) that routes various types of communications, such as data, voice, and video, into the building 110. The antenna unit 112 may include one of a DSL modem, a cable modem, an optical fiber, a satellite modem, Ethernet, a coaxial cable data interface such as Multimedia over Coax Alliance (MoCA) or HPNA, and a wireless metropolitan area network in order to route the various types of communications which are sent to wireless devices.

The antenna unit 112 includes one or more antenna circuits with each antenna circuit including one or more ports to send and receive signals to and from the transceiver. In one embodiment, the antenna unit 112 includes a wide area network (WAN) modem that is located in the NID 104 that is located outside of the building 110. In other embodiments, the antenna unit 112 is located inside of the building 110.

In certain embodiments, the antenna unit 112 transmits 802.11 RF frequencies throughout the building 110 to various wireless devices 140, 142, and 144. A wireless device receives the 802.11 RF frequencies and also transmits back to the antenna unit 112 a communication that is sent from the antenna unit 112 to the DSLAM 102 in order to access the public telephone network or other wide or local area networks.

Figure 3:
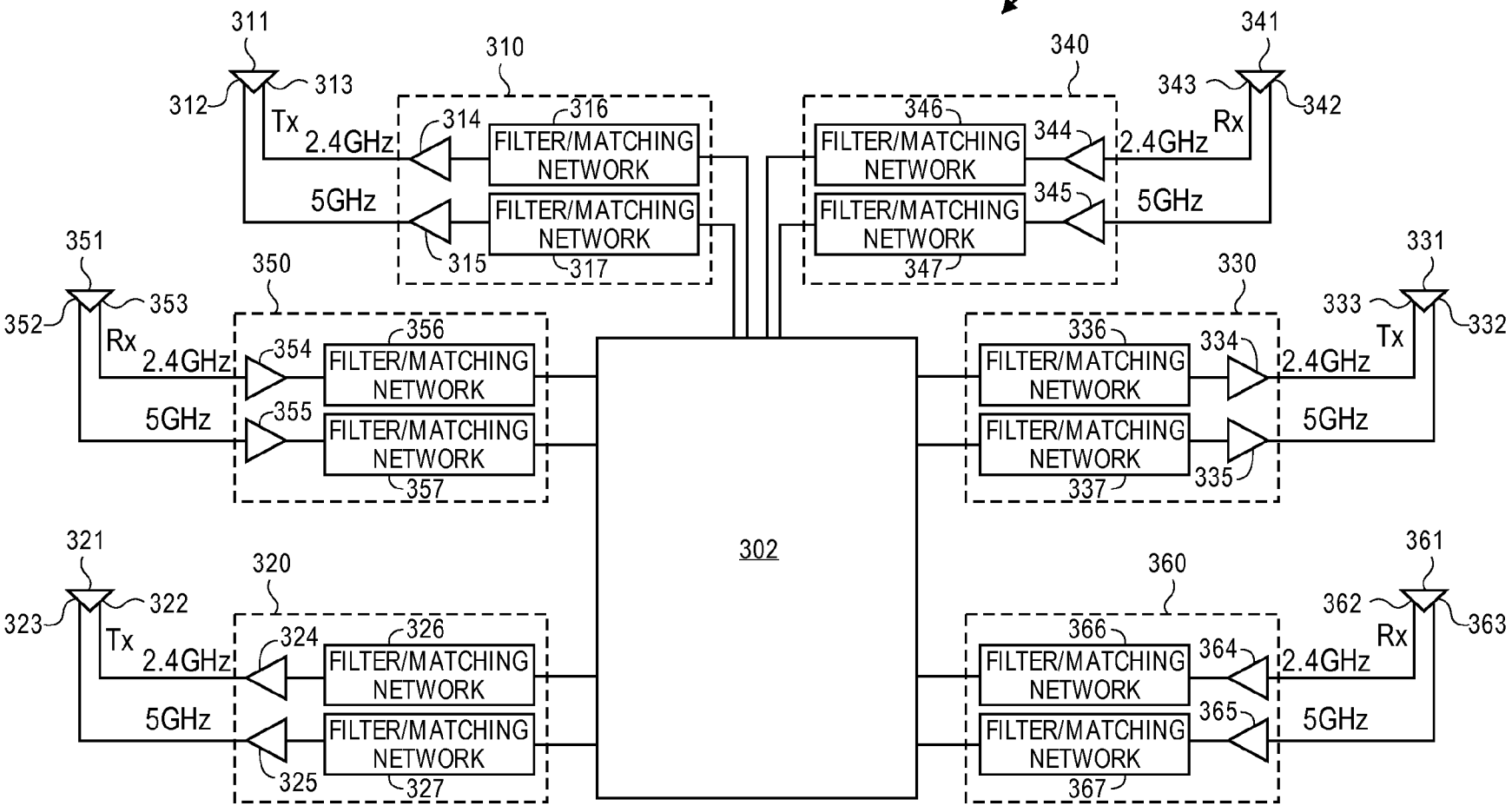
FIG. 3 shows a block diagram of an embodiment of a multiple input multiple output (MIMO) antenna unit with dual band antennas and an integrated circuit.

FIG. 3 shows a block diagram of an embodiment of a multiple input multiple output (MIMO) antenna unit with dual band antennas and an integrated circuit. The MIMO antenna unit 300 includes a plurality of transmit antenna circuits 310, 320, and 330 and a plurality of transmit antenna structures 311, 321, 331. These structures each have feed points 312, 313, 322, 323, 332, and 333, respectively, that are coupled to associated transmit antenna circuits to receive transmit signals transmitted from a transceiver unit 302, which is an integrated circuit. The feed points can be integrally formed with these structures or be coupled to the structures.

The feed points 312, 322, and 332 are configured to maximize coupling into the antenna structures 311, 321, and 331, respectively, at a first frequency band, which can be any RF band. The feed points 313, 323, and 333 are configured to maximize coupling into the antenna structures 311, 321, and 331, respectively, at a second frequency band (e.g., 5 GHz). Each antenna structure has a resonate plate having a slot that separates the resonate plate into a first patch associated with the first feed point and the first frequency band and a second patch associated with the second feed point and the second frequency band. In this embodiment, the first frequency band can be approximately 2.4 to 2.5 GHz and the second frequency band can be approximately 5.15 to 5.85 GHz.

The MIMO antenna unit 300 also includes a plurality of receive antenna circuits 340, 350, and 360 and a plurality of receive antenna structures 341, 351, 361. These structures 341, 351, and 361 each have feed points 342, 343, 352, 353, 362, and 363, respectively, that are coupled to associated receive antenna circuits to send receive signals to the transceiver unit 302. The feed points can be integrally formed with these structures or be coupled to the structures.

The feed points 342, 352, and 362 are configured to maximize coupling into the antenna structures 341, 351, 361, respectively, at the first frequency band. The feed points 343, 353, and 362 are configured to maximize coupling into the antenna structures 341, 351, and 361, respectively, at the second frequency band. Each antenna structure has a resonate plate having a slot that separates the resonate plate into a first patch associated with the first feed point and the first frequency band and a second patch associated with the second feed point and the second frequency band.

The transmit and receive antenna circuits include amplifiers 314, 315, 324, 325, 334, 335, 344, 345, 354, 355, 364, and 365 which amplify transmit signals that are generated from the transceiver unit 302 or amplify receive signals that are sent to the transceiver unit 302. Additionally, the antenna circuits include filter/matching networks 316, 317, 326, 327, 336, 337, 346, 347, 356, 357, 366, and 367 for coupling the transmit signals received from the transceiver unit 302 to the transmit antenna structures or for coupling the receive signals sent to the transceiver unit 302 from the receive antenna structures.

In wireless communication systems such as the antenna unit 300, a MIMO design utilizes multiple antennas at both the transmitter and receiver to improve communication performance. This design offers significant increases in data throughput and link range without additional bandwidth or transmit power. This design achieves significant increases in data throughput and link range with higher spectral efficiency (more bits per second per hertz of bandwidth) and link reliability or diversity (reduced fading). Each antenna provides both spatial and frequency diversity. A single structure multiplexing antenna (e.g., 310, 320, 330, 340, 350, or 360) provides transmission or reception of two or more radio frequency signals. Multiple feed points of the multiplexing antenna are coupled to respective receive inputs of the MIMO transceiver unit 302. Multiple feed points of the multiplexing antennas are coupled to respective transmit outputs of the MIMO transceiver unit 302. Each multiplexing antenna is constructed in a single structure. Each feed point is designed to work for a specific radio frequency band of interest thus eliminating the need of frequency multiplexers when coupling with the transceivers of the transceiver unit 302. The overall structure of each multiplexing antenna is less than that of combining multiple single frequency antennas thus reducing overall size.

Figure 4:
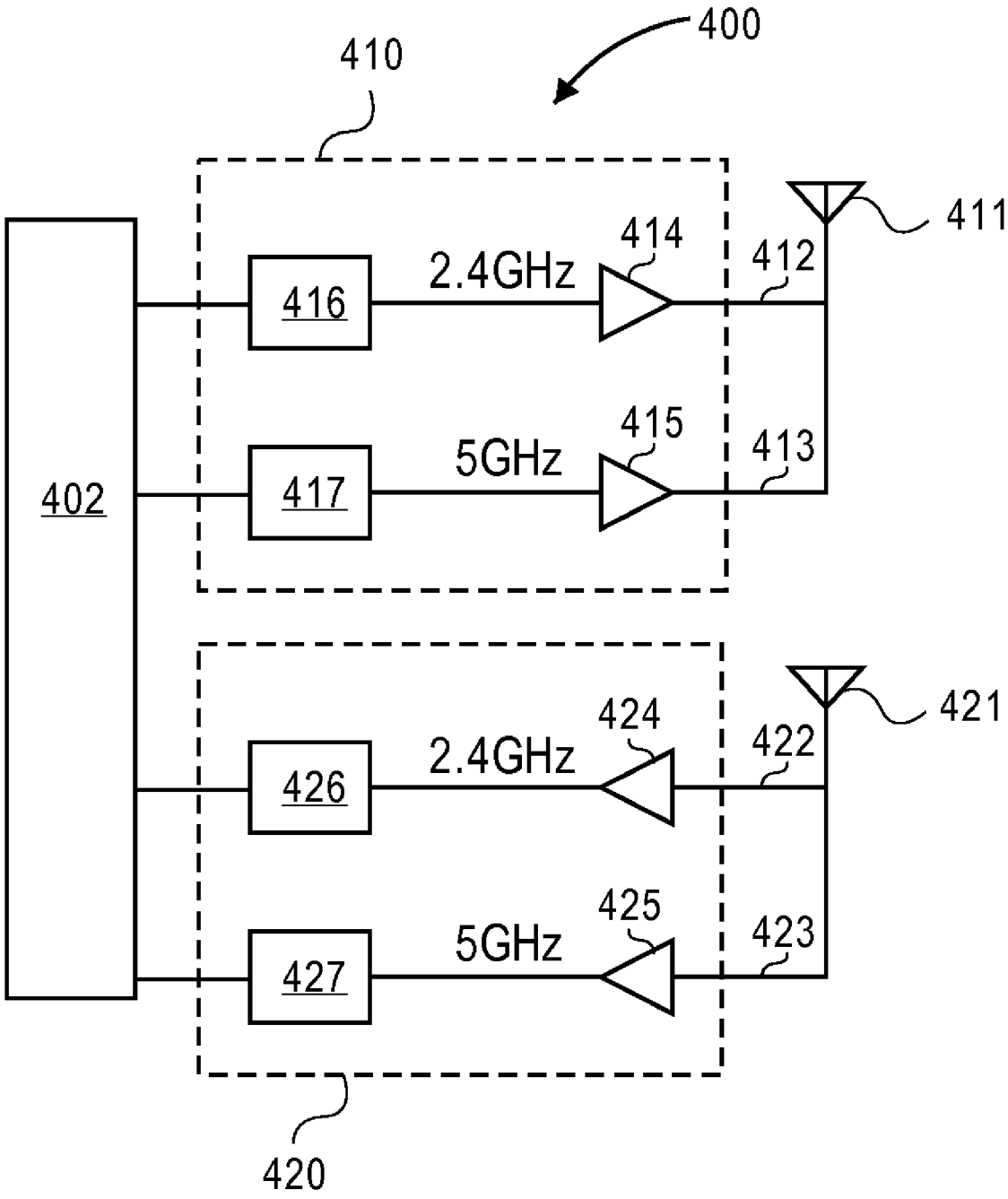
FIG. 4 shows a block diagram of an embodiment of a dual frequency band antenna unit.

FIG. 4 shows a block diagram of an embodiment of a dual frequency band antenna unit. The dual frequency band antenna unit 400 includes a first antenna circuit 410 coupled to an antenna structure 411 having a feed point 412 and a feed point 413 to receive one or more transmit signals transmitted from a transceiver unit 402. The feed point 412 is configured to maximize coupling into the antenna structure 411 at a first frequency band and the second feed point 413 is configured to maximize coupling into the antenna structure 411 at a second frequency band.

In one embodiment, the antenna structure 411 has a resonate plate having a slot that separates the antenna structure into a first patch associated with the first feed point and the first frequency band and a second patch associated with the second feed point and the second frequency band. The first frequency band can be approximately 2.4 to 2.5 GHz and the second frequency band can be approximately 5.15 to 5.85 GHz. Other RF bands can be implemented as well. The antenna structure 411 is operatively coupled to the transceiver unit without an intervening multiplexing functionality or circuitry (e.g., diplexer, multiplexer, switch).

The dual frequency band antenna unit 400 further includes a second antenna circuit 420 coupled to an antenna structure 421 having a feed point 422 and a feed point 423 to transmit one or more receive signals to the transceiver unit 402. The feed point 422 is configured to maximize coupling into the antenna structure 421 at the first frequency band and the second feed point 423 is configured to maximize coupling into the antenna structure 421 at the second frequency band. The antenna structure 421 is operatively coupled to the transceiver unit without an intervening multiplexing functionality or circuitry.

The transmit and receive antenna circuits include amplifiers 414, 415, 424, and 425 which amplify transmit signals that are generated from the transceiver unit 402 or amplify receive signals that are sent to the transceiver unit 402. Additionally, the antenna circuits include filter/matching networks 416, 417, 426, and 427 for coupling the transmit signals received from the transceiver unit 402 to the transmit antenna structures or for coupling the receive signals sent to the transceiver unit 402 from the receive antenna structures.

In one embodiment, the antenna structure 421 has a slot that separates the antenna structure 421 into a first patch associated with the first feed point and the first frequency band and a second patch associated with the second feed point and the second frequency band. The first frequency band can be approximately 2.4 to 2.5 GHz ISM band and the second frequency band can be approximately 5.15 to 5.85 GHz Unlicensed National Information Infrastructure (UNII) band. Other RF bands can be implemented as well based upon Federal Communications Commission (FCC) spectrum allocations. For example, an antenna unit can be designed to work with an additional Global System for Mobile communications (GSM) band at 900 MHz to form a triple frequency triple feed transceiver system as illustrated in FIG. 5.

Figure 5:
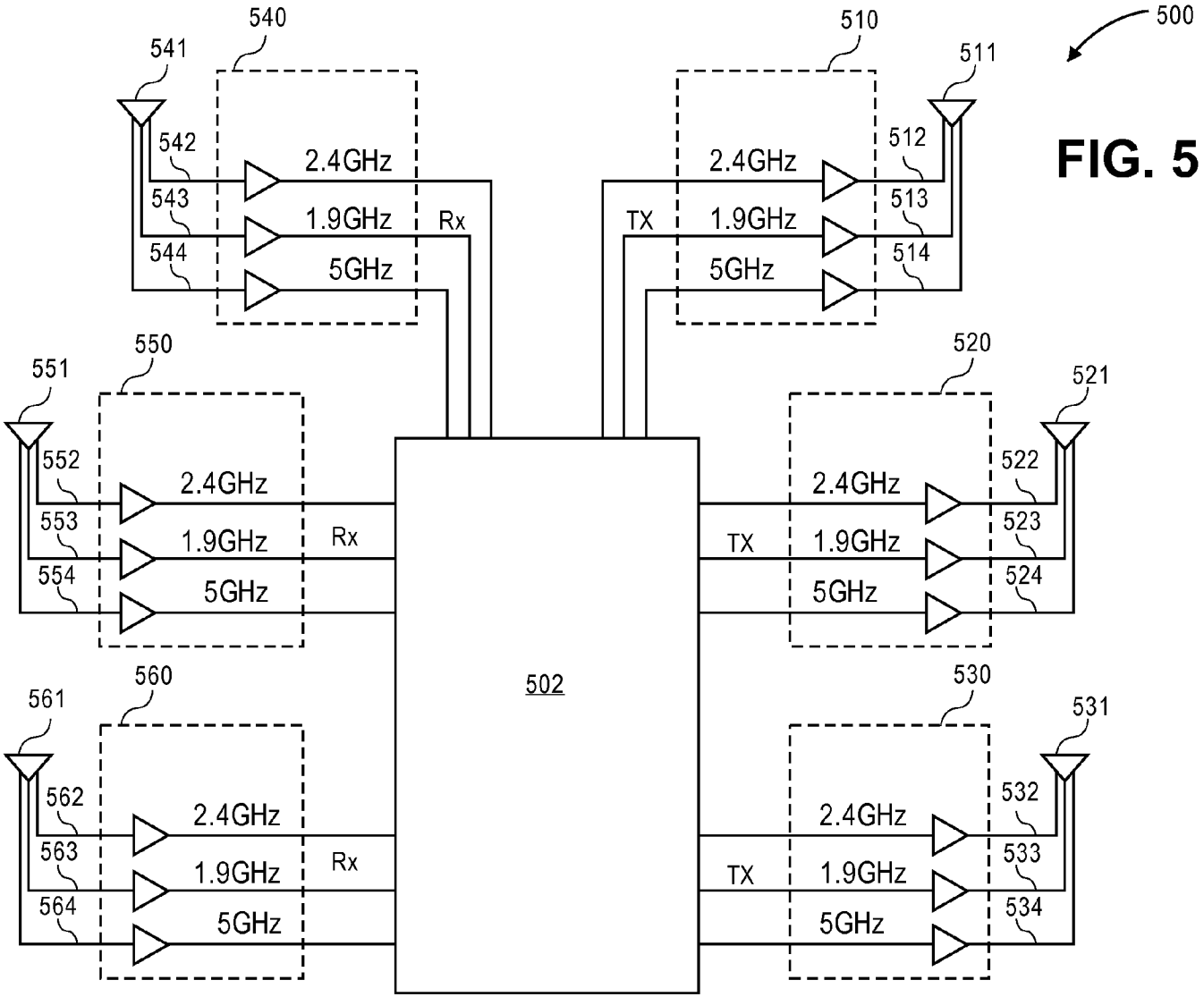
FIG. 5 shows a block diagram of an embodiment of a multiple frequency band antenna unit.

FIG. 5 shows a block diagram of an embodiment of a multiple band antenna unit. The multiple frequency band antenna unit 500 includes a transmit antenna circuit 510 coupled to an antenna structure 511 having a feed point 512, a feed point 513, and a feed point 514 to receive one or more transmit signals transmitted from a transceiver unit 502. The antenna unit 500 may further include antenna circuits 520 and 530 coupled to antenna structures 521 and 531 having feed points 522, 523, 524, 532, 533, and 534, respectively.

In one embodiment, the feed points 512, 522, and 532 are configured to maximize coupling into antenna structures 511, 521, and 531, respectively, at a first frequency band. The feed points 513, 523, and 533 are configured to maximize coupling into the respective antenna structures at a second frequency band. The feed points 514, 524, and 534 are configured to maximize coupling into the respective antenna structures at a third frequency band. Each antenna structure is operatively coupled to the transceiver unit 502 without an intervening multiplexing functionality or circuitry.

The multiple frequency band antenna unit 500 further includes a receive antenna circuit 540 coupled to an antenna structure 541 having a feed point 542, a feed point 543, and a feed point 544 to send one or more receive signals to the transceiver unit 502. The antenna unit 500 may further include antenna circuits 550 and 560 coupled to antenna structures 551 and 561, respectively, having feed points 552, 553, 554, 562, 563, and 564, respectively.

In one embodiment, the feed points 542, 552, and 562 are configured to maximize coupling into antenna structures 541, 551, and 561, respectively, at the first frequency band. The feed points 543, 553, and 563 are configured to maximize coupling into the respective antenna structures at a second frequency band. The feed points 544, 554, and 564 are configured to maximize coupling into the respective antenna structures at a third frequency band. The antenna circuits in FIG. 5 may also include amplifiers and filter/matching networks in a similar manner as previously discussed in connection with the description of FIGS. 3 and 4.

Each antenna structure is operatively coupled to the transceiver unit 502 without an intervening multiplexing functionality or circuitry. The first, second, and third frequency bands may be RF bands. In one embodiment, the first frequency band can be approximately 2.4 to 2.5 GHz, the second frequency band can be approximately 1.9 to 2.0 GHz, and the third frequency band can be approximately 5.15 to 5.85 GHz.

Figure 6:
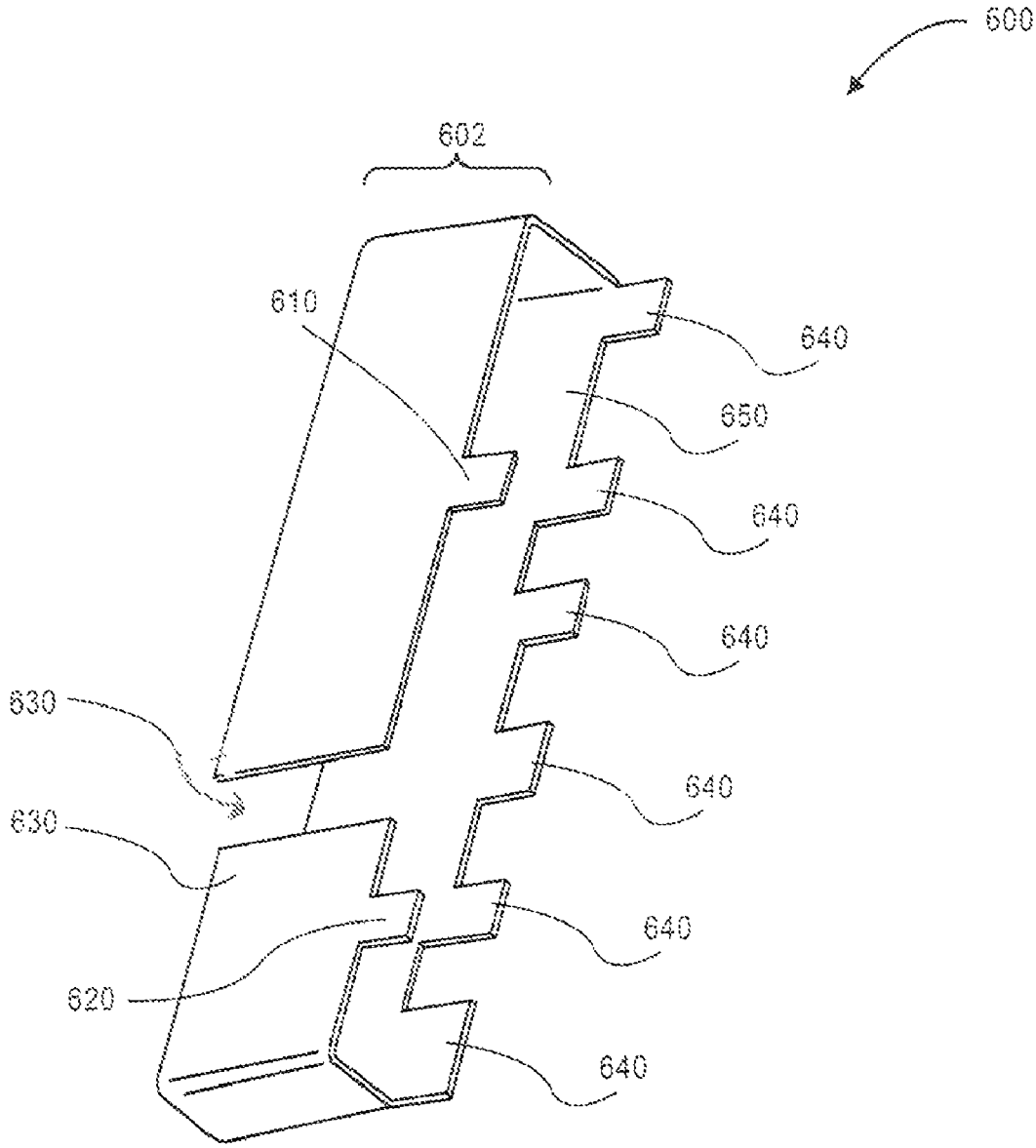
FIG. 6 shows an embodiment of a dual band antenna structure.

FIG. 6 shows an illustration of an embodiment of a dual band antenna structure. In order to eliminate the need for external frequency multiplexers, each feed point 610 and 620 of the multiplexing antenna structure 600 provides good return loss or voltage standing wave ratio only in its designated band of frequency and appears as an open termination to all other frequency bands. In an antenna system, a return loss of less than −10 dBc or VSWR of less than 2.0 is considered to provide good performance. Therefore, each feed point is designed to maximize coupling into a resonate plate 602 of the multiplexing antenna structure 600 at only one frequency band.

In one embodiment, the structure 600 is constructed from a single piece of malleable metallic material (e.g., stamped sheet metal). Tabs are formed to provide installation into a printed circuit board. There are six ground tabs 640 attached to a ground plane 650 and two feed point tabs 610 and 620 attached to a resonate plate 602 with one feed point for each of the frequency bands. The tabs can be integrally formed with the ground plane and resonate plate or coupled to the ground plane and resonate plate. The resonate plate 602 includes a first patch attached to the feed point tab 610 and a second patch attached to the feed point tab 620. A slot 630 is formed between two end edges of the patches, which are resonating elements. The slot 630 can be chosen to create two separate frequencies such as 2.4 GHz and 5.5 GHz. The slot 630 can be of various lengths, widths, and shapes depending on the desired frequency bands of interest. The slot 630 can be continuous or in segments. Multiple slots may also be used to design a multiple frequency band antenna.

In FIG. 6, each feed point is attached at a location on the resonate plate 602 where the electric field is at a maximum at its resonating frequency band and low at all other frequency bands. Energy coupled to the antenna structure 600 at the first feed point 610 may cause the antenna to resonate at 2.4 GHz and the energy will be radiated. Likewise, energy coupled to the antenna structure 600 at the second feed point 620 may cause the antenna to resonate to 5 GHz and the energy will be radiated.

Figure 7:
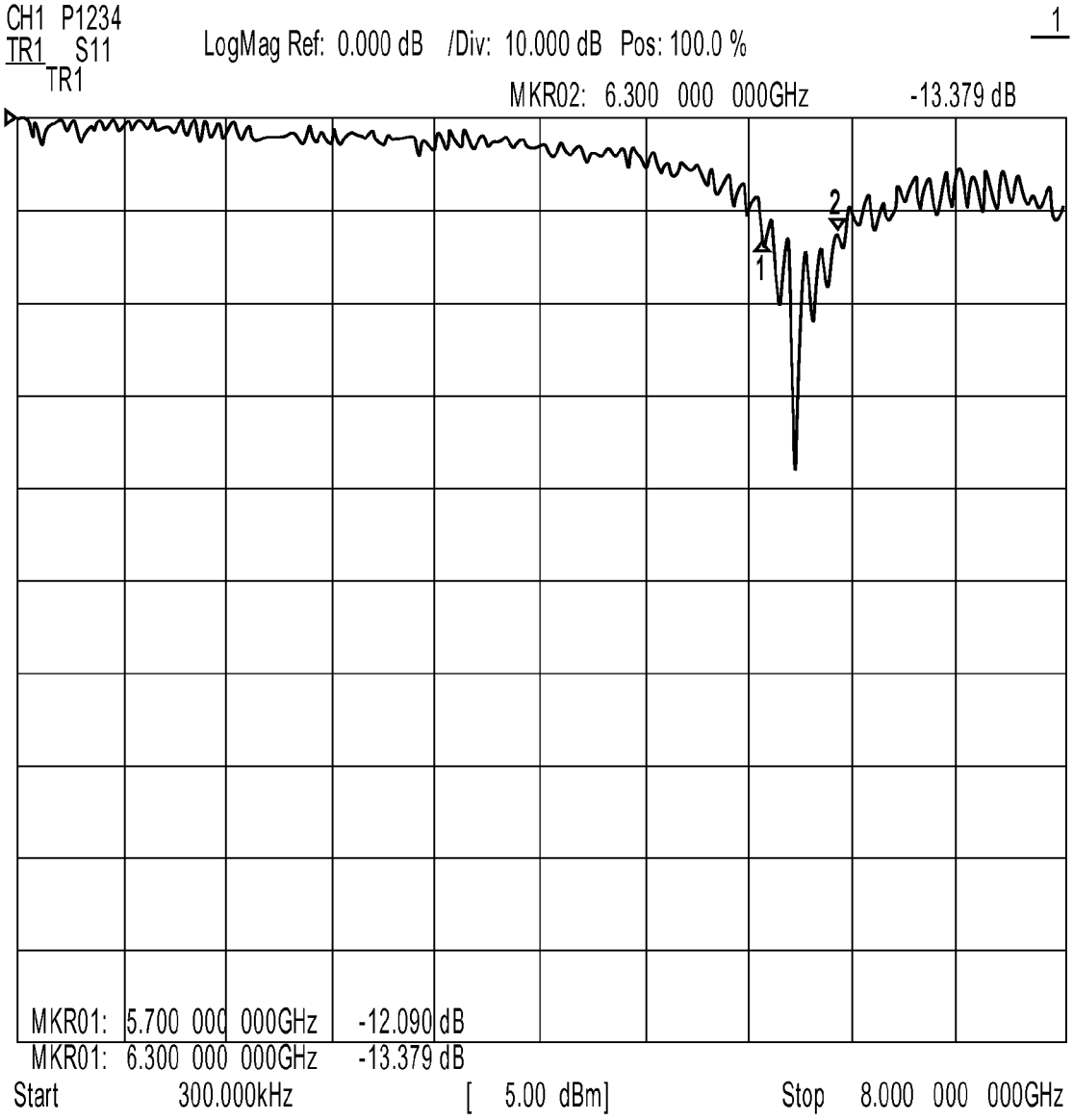
FIG. 7 shows a frequency response graph for a dual band antenna structure in accordance with one embodiment.
Figure 8:
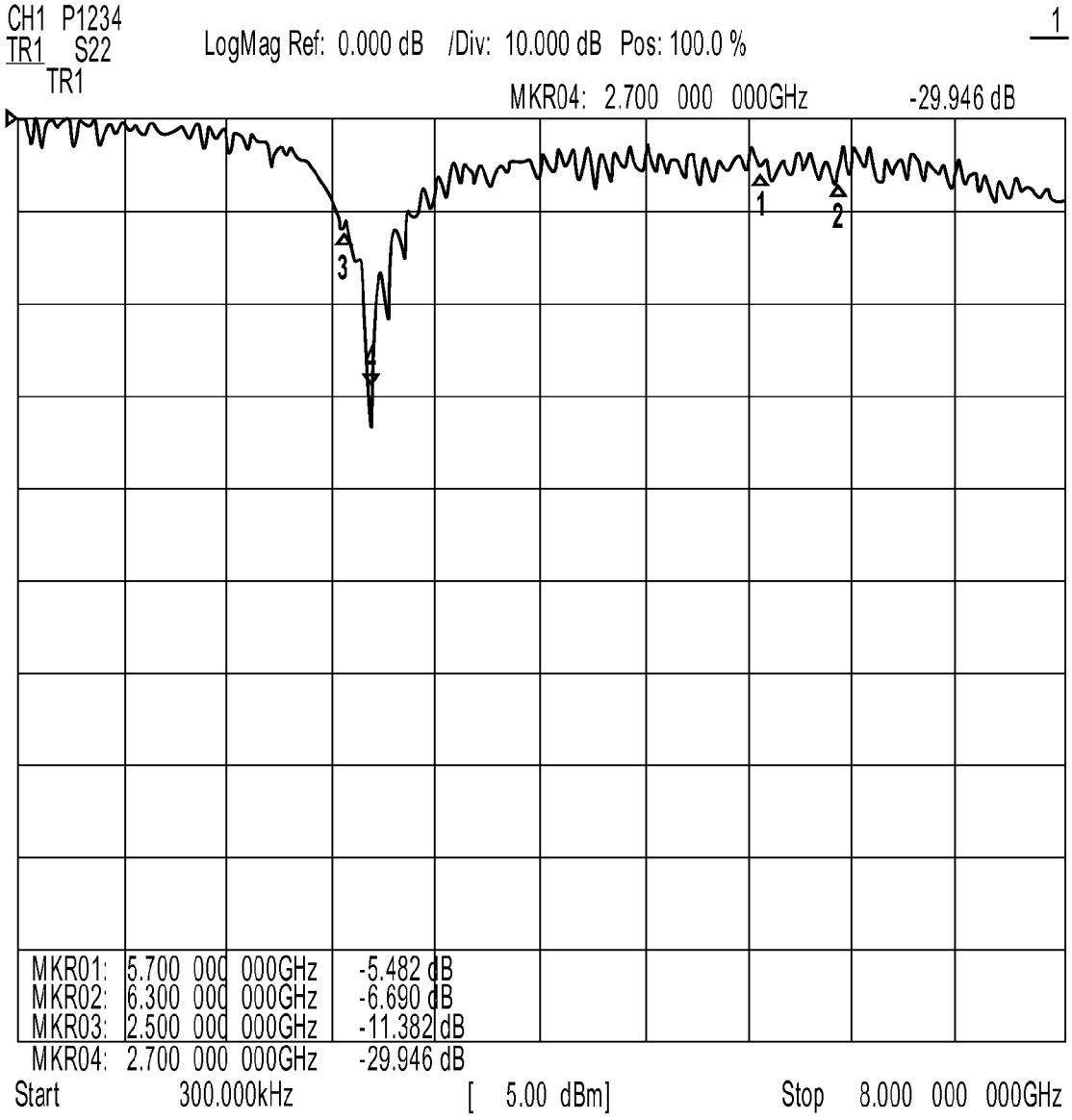
FIG. 8 shows a frequency response graph for a dual band antenna structure in accordance with another embodiment.

FIG. 7 shows a frequency response graph for a dual band antenna in accordance with one embodiment in which a resonating frequency band of 5.7 GHz to 6.3 GHz is near a minimum return loss in units of decibels. Other frequencies have a return loss near 0 dB indicating they do not affect the resonating frequency band of interest from 5.7 GHz to 6.3 GHz. FIG. 8 shows a frequency response graph for a dual band antenna in accordance with another embodiment in which a resonating frequency band of 2.5 GHz to 2.7 GHz is near a minimum return loss in units of decibels. Other frequencies (e.g., 5.7 GHz to 6.3 GHz) have a return loss near 0 dB indicating they do not affect the resonating frequency band of interest from 2.5 GHz to 2.7 GHz.

In one embodiment, when the 2.4 GHz feed point is operating, the 2.4 GHz feed point appears as a mis-terminated transmission line attached at the 5 GHz feed point. Conversely, when the 5 GHz feed point is operating, the 5 GHz feed point appears as a mis-terminated transmission line attached at the 2.4 GHz feed point. The location of the feed point is affected by the size and shape of the resonating element, the distance between the resonating element and its nearest ground plane, and the size, shape, and location of slot(s).

The location of the feed points affects the impedance as well as the resonating frequency of the frequency band of interest. The closer the proximity of the feed point to ground causes the resonating frequency to decrease. Conversely, the farther the feed point is away from ground, the resonating frequency increases. The proximity of the entire resonating structure to ground affects the impedance of the feed point. Normally, a 50 ohm impedance is ideal in high frequency transmission line circuits. By varying the feed points, slots, and resonator shapes, a return loss of better than −10 dBc reference to a 50 ohm transmission system can be achieved. The return loss indicates the feed point is well matched to that particular band of RF spectrum.

For some embodiments, the ground plane 650 has a length of approximately 40 millimeters (mm) and a height of 15 mm. The ground plane 650 is spaced approximately 5 to 7 mm from the first patch and the second patch is spaced approximately 3 to 5 mm from the ground plane for 2.4 GHz and 5 GHz frequency bands. The slot 630 may have a width spacing of approximately 2 to 4 mm that separates the first and second patches and a length of approximately 14 to 16 mm. The first patch 604 may have an area that is approximately two to two and one half times larger than an area of the second patch 606. The first patch 604 may have a length of 10 to 14 mm, a height of 14 to 16 mm, and a thickness of 0.2 to 0.4 mm. The second patch 606 may have a length of 20 to 30 mm, a height of 14 to 16 mm, and a thickness of 0.2 to 0.4 mm. The patches may be different shapes (e.g., polygon, square, rectangle, trapezoid, circle, oval, triangle, etc.), sizes, and metallic malleable materials for a given frequency application.

Figure 9:
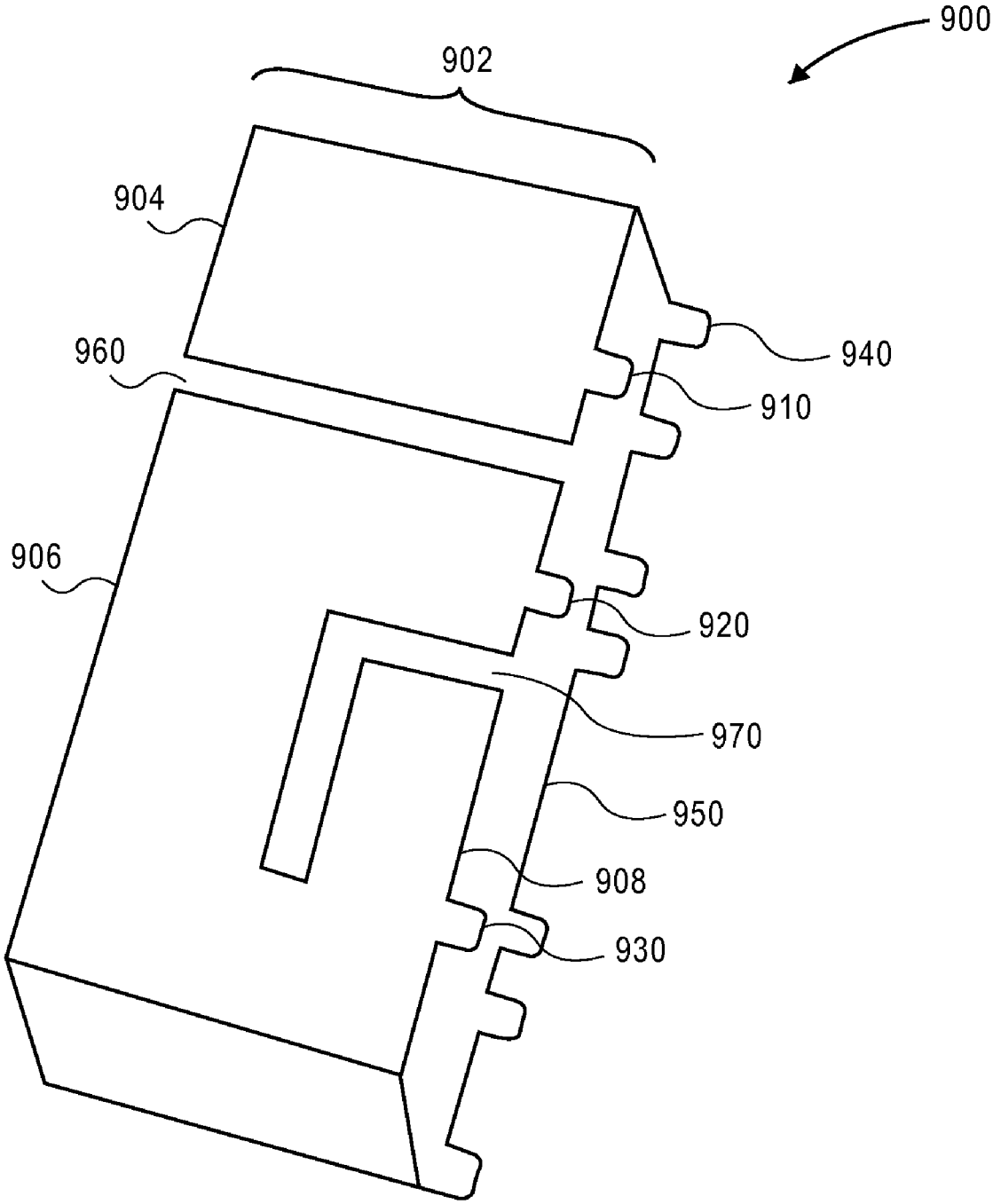
FIG. 9 shows an embodiment of a multiple band antenna structure.

FIG. 9 shows a block diagram of an embodiment of multiple band antenna structure. The structure 900 is constructed from a single piece of malleable metallic material (e.g., stamped sheet metal) that can be printed on a multi-layer printed circuit board with its dimensions optimized to the material dielectric characteristics. Tabs are formed to provide installation into a printed circuit board. In one embodiment, seven ground tabs 940 are attached to a ground plane 950 and three feed point tabs 910, 920, and 930 are attached to a resonate plate 902 with one feed point for each of the three frequency bands (e.g., 2.4 GHz, 1.9 GHz, 5 GHz). The resonate plate 902 includes a patch 904 attached to the feed point tab 910 and associated with a first frequency band, a patch 906 attached to the feed point tab 920 and associated with a second frequency band, and a patch 908 attached to the feed point tab 930 and associated with a third frequency band. A slot 960 is formed between two end edges of the patches 904 and 906, which are resonating elements. A slot 990 is formed between two end edges of the patches 906 and 908. Each slot can be chosen to create two separate resonating frequencies resulting in three frequency bands for the antenna structure 900. The slots can be of various lengths, widths, and shapes depending on the desired frequency bands of interest. The slots can be continuous or in segments. Slot 960 completely separates the patches 904 and 906. In contrast, slot 990 partially separates the patches 906 and 908.

In certain embodiments with first, second, and third frequency bands of approximately 2.4 GHz, 1.9 GHz, and 5 GHz, respectively, the patch 904 has an area that is approximately one and one half to two times smaller than an area of the patch 906. The patch 906 has an area that is approximately two to two and one half times larger than an area of the patch 908. The antenna structure 900 is coupled to the ground plane 950 with the patch 904 being spaced approximately 4 to 6 millimeters from the ground plane 950. The patch 906 is spaced approximately 6 to 8 millimeters from the ground plane 950 and the patch 908 is spaced approximately 6 to 8 millimeters from the ground plane 950. The slot 960 has a width spacing of approximately two to four millimeters that completely separates the patches 904 and 906 and the slot 970 has a width spacing of approximately 0.5 to 1.5 millimeters (mm) that partially separates the patches 906 and 908. Patch 904 has dimensions of approximately 14 mm by 10 mm. Patch 906 has dimensions of approximately 14 mm by 24 mm. Patch 908 has dimensions of approximately 5 mm by 18 mm. The ground plane has dimensions of approximately 14 mm by 40 mm. Slots width 970 is approximately 1 mm.

Figure 10:
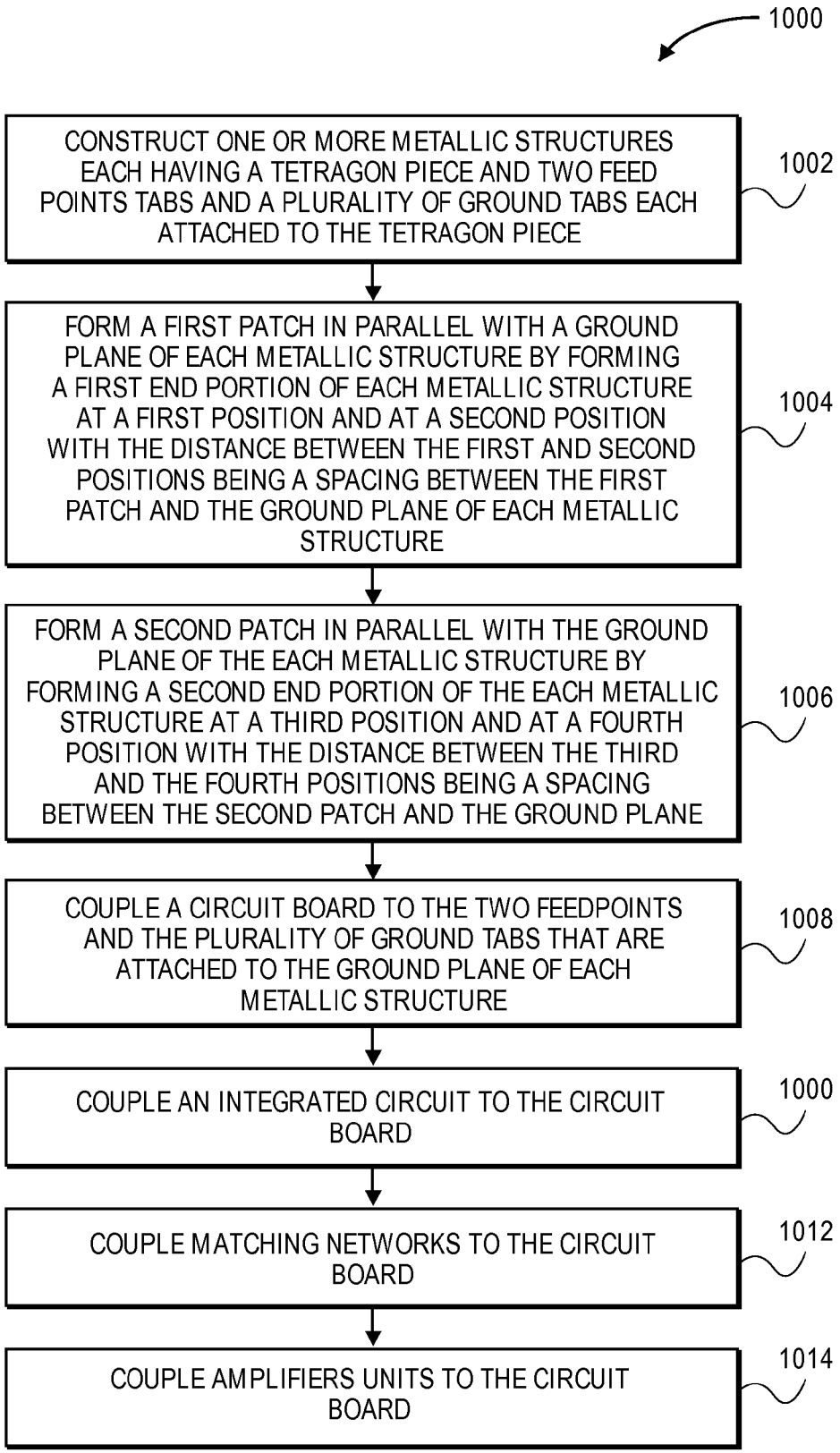
FIG. 10 shows a method of manufacturing a multiple band antenna unit in accordance with an embodiment.

FIG. 10 shows a method of manufacturing a dual band antenna unit in accordance with one embodiment. The method of manufacturing the dual band antenna unit includes constructing one or more metallic structures each having a tetragon piece with two feed points tabs and a plurality of ground tabs each attached to the tetragon piece at block 1002. The tetragon piece is a four sided polygon, but other types of polygons and shapes can be used as well in forming the metallic structures. The method further includes forming a first patch in parallel with a ground plane of each metallic structure by forming a first end portion of each metallic structure at a first position and at a second position with a distance between the first and second positions being a spacing between the first patch and the ground plane of each metallic structure at block 1004. The method further includes forming a second patch in parallel with the ground plane of the each metallic structure by forming a second end portion of each metallic structure at a third position and at a fourth position with a distance between the third and the fourth positions being a spacing between the second patch and the ground plane at block 1006.

The first feed point of each metallic structure is attached to the first patch and is configured to maximize coupling into the first patch at a first frequency band and the second feed point of each metallic structure is attached to the second patch and is configured to maximize coupling into the second patch at a second frequency band. The method further includes coupling a circuit board to the two feed points and the plurality of ground tabs that are attached to the ground plane of each metallic structure at block 1008. The method further includes coupling an integrated circuit to the circuit board at block 1010. The method further includes coupling matching networks to the circuit board at block 1012. The method further includes coupling amplifiers units to the circuit board at block 1014.

In one embodiment, each feed point of each metallic structure is coupled to one of the amplifier units which is coupled to one matching network which is directly coupled to the integrated circuit with no intervening multiplexing or demultiplexing functionality or circuitry. Each metallic structure has a slot that separates the first patch and the second patch with the first patch having an area that is approximately two to two and one half times larger than an area of the second patch. An overall size of the first patch and second patch in combination of each metallic structure is reduced based on an interaction between the first patch and the second patch when separated by the slot. The slot has a width spacing of approximately two to four millimeters that separates the first and second patches.

One advantage of the antenna units described in the present disclosure is the elimination of a diplexer or a multiplexer as well as transmit/receive (TX/RX) transfer switches thus simplifying system design. Elimination of these other components increases the system efficiency in the system RF signal propagation. Another advantage is a single compact antenna structure with a reduced overall size instead of using multiple single frequency band antennas. This is due to an interaction between the resonators. When the fore mentioned locations, sizes, shapes of the slots, feed points, and ground plane are optimized, the interaction reduces the overall size but not the desired performance and characteristics of the multiplexing antenna structure.

Although the operations of the method(s) herein are shown and described in a particular order, the order of the operations of each method may be altered so that certain operations may be performed in an inverse order or so that certain operation may be performed, at least in part, concurrently with other operations. In another embodiment, instructions or sub-operations of distinct operations may be in an intermittent and/or alternating manner.

While some specific embodiments of the disclosure have been shown the disclosure is not to be limited to these embodiments. The disclosure is to be understood as not limited by the specific embodiments described herein, but only by scope of the appended claims.

What is claimed is:

1. A dual frequency band antenna unit comprising:

a first antenna structure comprising a resonate plate having a slot that separates the resonate plate into a first patch associated with a first feed point and a corresponding first frequency band and a second patch associated with a second feed point and a corresponding second frequency band with the first patch having an area that is approximately two to two and one half times larger than an area of the second patch;

a first antenna circuit coupled to the first feed point and the second feed point to receive one or more signals transmitted from a transceiver unit;

a second antenna structure comprising a resonate plate having a slot that separates the resonate plate into a first patch associated with a first feed point of the second antenna structure and the first frequency band and a second patch associated with a second feed point of the second antenna structure and the second frequency band with the first patch having an area that is approximately two to two and one half times larger than an area of the second patch; and a second antenna circuit coupled to the first feed point and the second feed point of the second antenna structure to send one or more receive signals to the transceiver unit, wherein the first feed point is configured to maximize coupling into the second antenna structure at the first frequency band and the second feed point is configured to maximize coupling into the second antenna structure at the second frequency band.

2. The dual frequency band antenna unit of claim 1, wherein the first feed point is configured to maximize coupling into the first antenna structure at the first frequency band and the second feed point is configured to maximize coupling into the first antenna structure at the second frequency band.

3. The dual frequency band antenna unit of claim 1, wherein the first antenna structure is operatively coupled to the transceiver unit without an intervening multiplexing circuit.

4. The dual frequency band antenna unit of claim 1, wherein the first antenna structure is coupled to a ground plane with the first patch being spaced approximately five to seven millimeters from the ground plane and the second patch being spaced approximately three to five millimeters from the ground plane.

5. The dual frequency band antenna unit of claim 1, wherein the slot has a width spacing of approximately two to four millimeters that separates the first and second patches.

6. The dual frequency band antenna unit of claim 1, wherein the second antenna circuit is operatively coupled to the transceiver unit without an intervening demultiplexing circuit.

7. A multiple frequency band antenna unit comprising:

a first antenna structure comprising a resonate plate having a first slot that separates the resonate plate into a first patch associated with a first feed point and a first frequency band and a second patch associated with a second feed point and a second frequency band with the first patch having an area that is approximately one and one half to two times smaller than an area of the second patch;

a first antenna circuit coupled to the first feed point and the second feed point to receive one or more transmit signals transmitted from a transceiver unit; and wherein the resonate plate has a second slot that partially separates the resonate plate into the second patch associated with the second feed point and the second frequency band and a third patch associated with a third feed point and a third frequency band with the second patch having an area that is approximately two to two and one half times larger than an area of the third patch.

8. The multiple frequency band antenna unit of claim 7, wherein the first feed point is configured to maximize coupling into the first antenna structure at the first frequency band, the second feed point is configured to maximize coupling into the first antenna structure at the second frequency band, the third feed point is configured to maximize coupling into the first antenna structure at the third frequency band.

9. The multiple frequency band antenna unit of claim 7, wherein the first antenna structure is operatively coupled to the transceiver unit without an intervening multiplexing circuit.

10. The multiple frequency band antenna unit of claim 7, wherein the resonate plate is coupled to a ground plane with the first patch being spaced approximately 4 to 6 millimeters from the ground plane, the second patch being spaced approximately 6 to 8 millimeters from the ground plane, and the third patch being spaced approximately 6 to 8 millimeters from the ground plane.

11. The multiple frequency band antenna unit of claim 7, wherein the first slot has a width spacing of approximately two to four millimeters that separates the first and second patches and the second slot has a width spacing of approximately 0.5 to 1.5 millimeters that partially separates the second and third patches.

12. The multiple frequency band antenna unit of claim 7, further comprising:

a second antenna structure comprising a resonate plate having a first slot that separates the resonate plate into a first patch associated with a first feed point and the first frequency band and a second patch associated with a second feed point and the second frequency band with the first patch having an area that is approximately one and one half to two times smaller than an area of the second patch; and a second antenna circuit coupled to the first feed point and the second feed point of the second antenna structure to send one or more receive signals to the transceiver unit.

13. The multiple frequency band antenna unit of claim 12, wherein the resonate plate has a second slot that partially separates the resonate plate into the second patch associated with the second feed point and the second frequency band and a third patch associated with a third feed point and a third frequency band with the second patch having an area that is approximately two to two and one half times larger than an area of the third patch.

14. A multiple input multiple output antenna unit comprising:

a plurality of transmit antenna structures each comprising a resonate plate having a slot that separates the resonate plate into a first patch associated with a first feed point and a first frequency band and a second patch associated with a second feed point and a second frequency band with the first patch having an area that is approximately two to two and one half times larger than an area of the second patch;

a plurality of transmit antenna circuits each coupled to the first feed point and the second feed point of an associated transmit antenna structure to receive transmit signals transmitted from a transceiver unit;

a plurality of receive antenna structures each comprising a resonate plate having a slot that separates the resonate plate into a first patch associated with a first feed point and the first frequency band and a second patch associated with a second feed point and the second frequency band with the first patch having an area that is approximately two to two and one half times larger than an area of the second patch; and a plurality of receive antenna circuits each coupled to the first feed point and the second feed point of an associated receive antenna structure to send receive signals to the transceiver unit.

15. The multiple frequency band antenna unit of claim 14, wherein the first feed point of each resonate plate is attached to the first patch of each resonate plate at a location where an electric field is at a maximum at the first frequency band with this location being based on a size and shape of the first patch, a distance between the first patch and its nearest ground plane, and a size, a shape, and a location of the slot of each resonate plate.

16. The multiple frequency band antenna unit of claim 14, wherein the second feed point of each resonate plate is attached to the second patch of each resonate plate at a location where an electric field is at a maximum at the second frequency band with this location being based on a size and shape of the second patch, a distance between the second patch and its nearest ground plane, and a size, a shape, and a location of the slot of each resonate plate.

17. The multiple frequency band antenna unit of claim 14, wherein the antenna unit includes at least one of a wide area network (WAN) modem, digital subscriber line modem, a cable modem, an optical fiber, a satellite modem, Ethernet, a coaxial cable data interface, and a wireless metropolitan area network.

18. A method of manufacturing a multiple band antenna unit comprising:

constructing one or more metallic structures each having a tetragon piece with at least two feed points tabs and a plurality of ground tabs attached to the tetragon piece;

forming a first patch in parallel with a ground plane of each metallic structure by forming a first end portion of each metallic structure at a first position and at a second position with the distance between the first and second positions being a spacing between the first patch and the ground plane of each metallic structure; and forming a second patch in parallel with the ground plane of each metallic structure by forming a second end portion of the each metallic structure at a third position and at a fourth position with the distance between the third and the fourth positions being a spacing between the second patch and the ground plane.

19. The method of manufacturing the dual band antenna unit of claim 18, wherein each metallic structure has a slot that separates the first patch and the second patch with the first patch having an area that is approximately two to two and one half times larger than an area of the second patch.

20. The method of manufacturing the dual band antenna unit of claim 19, wherein an overall size of the first patch and second patch in combination of each metallic structure is reduced based on an interaction between the first patch and the second patch when separated by the slot.

21. The method of manufacturing the dual band antenna unit of claim 18, further comprising:

coupling a circuit board to the at least two feed points and the plurality of ground tabs with the ground tabs being attached to the ground plane of each metallic structure;

coupling an integrated circuit to the circuit board;

coupling matching networks to the circuit board; and coupling amplifiers units to the circuit board, wherein each feed point of each metallic structure is coupled to one of the amplifier units which is coupled to one matching network which is directly coupled to the integrated circuit with no intervening multiplexing or demultiplexing functionality.

* * * * *